US006592470B2

(12) United States Patent
Watanabe et al.

(10) Patent No.: US 6,592,470 B2
(45) Date of Patent: Jul. 15, 2003

(54) SOLID MULTI-PIECE GOLF BALL

(75) Inventors: Hideo Watanabe, Chichibu (JP); Junji Umezawa, Chichibu (JP); Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/122,728

(22) Filed: Apr. 16, 2002

(65) Prior Publication Data

US 2002/0177492 A1 Nov. 28, 2002

(30) Foreign Application Priority Data

Apr. 24, 2001 (JP) ..... 2001-125715

(51) Int. Cl.[7] ..... A63B 37/06
(52) U.S. Cl. ..... 473/374
(58) Field of Search ..... 473/351, 367, 473/368, 370, 371, 372, 373, 374, 377

(56) References Cited

U.S. PATENT DOCUMENTS 4,919,434 A * 4/1990 Saito ..... 473/373
5,553,852 A 9/1996 Higuchi et al.
5,782,707 A 7/1998 Yamagishi et al.
5,899,822 A 5/1999 Yamagishi et al.

FOREIGN PATENT DOCUMENTS

JP 7-24085 1/1995
JP 9-239068 9/1997
JP 10-151226 6/1998

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A solid multi-piece golf ball includes a solid elastic core, an intermediate layer of a thermoplastic material and a cover. The core undergoes a deformation of 3.2–6.5 mm when subjected to a load of 1274 N from an initial load of 98 N. The cover has a Shore D hardness of 45–55 and the intermediate layer has a Shore D hardness of 54–65 and higher than that of the cover. The cover and the intermediate layer have a combined thickness of 2.3–3.5 mm and a ratio of cover thickness to intermediate layer thickness between 0.48 and 0.84. This combination of features provides the ball with qualities desired by professional golfers and skilled amateurs, including carry, spin performance, cracking resistance, topping durability, scuffing resistance, and feel.

5 Claims, 1 Drawing Sheet

SOLID MULTI-PIECE GOLF BALL

BACKGROUND OF THE INVENTION

1. Field of the Invention

Figure 1:
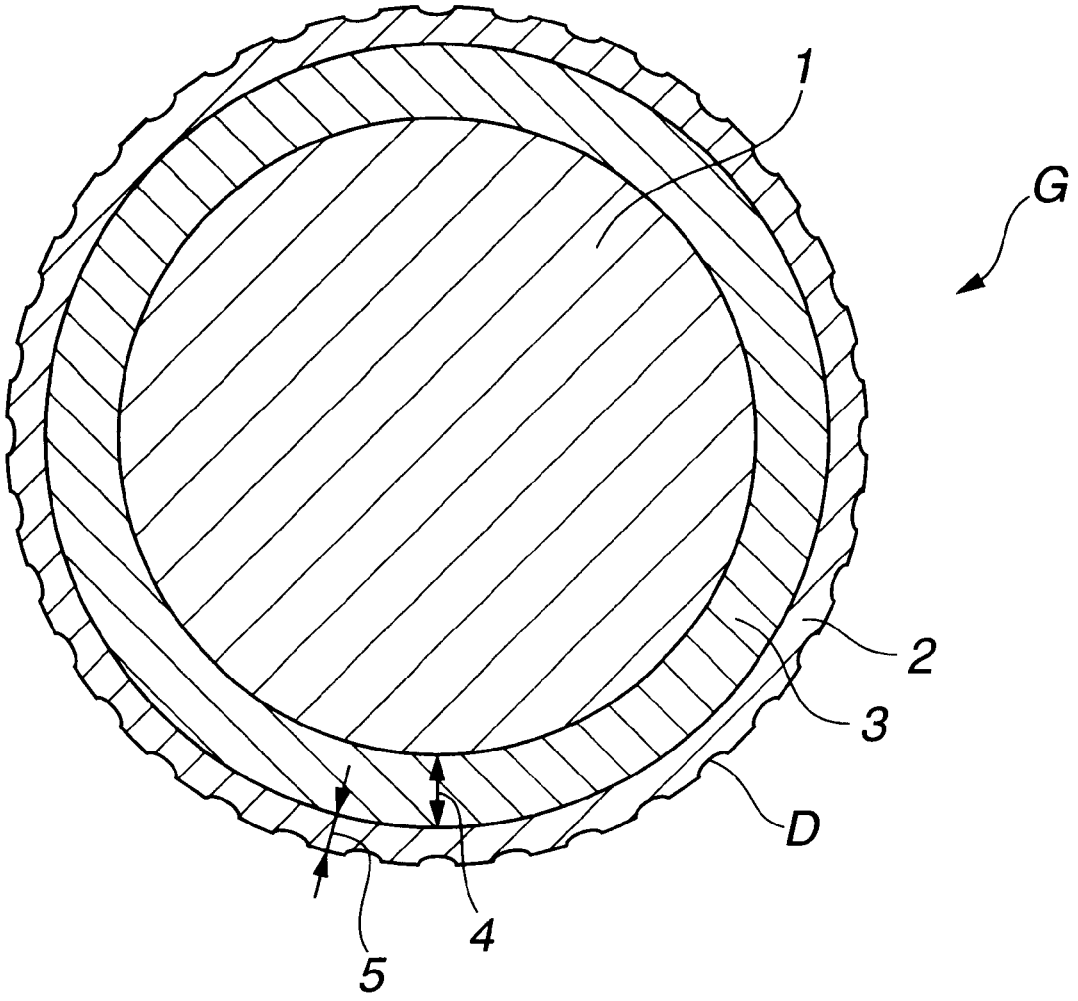

The present invention relates to a solid multi-piece golf ball which provides excellent flight performance, controllability on approach shots, "feel" upon impact, and durability.

2. Prior Art

Solid multi-piece golf balls having a solid core and a cover composed of at least two layers have already been proposed as golf balls which meet the requirements of professionals and other skilled golfers. For example, JP-A 7-24085 discloses a golf ball with a hard inner cover/soft outer cover construction in which the inner cover layer has a greater hardness than the outer cover. JP-A 10-151226 discloses a solid multi-piece golf ball of the same type which has an improved spin performance, durability and flight distance.

However, such improvements remain inadequate. A need continues to be felt for golf balls having certain qualities desired in particular by professionals and other skilled golfers, such as better spin performance when hit with an iron or on approach shots, and improved "feel" upon impact, durability and rebound energy.

SUMMARY OF THE INVENTION

It is therefore an object of the invention to provide a solid multi-piece golf ball having excellent flight performance, improved spin performance when hit with an iron and on approach shots, and improved feel upon impact, durability and rebound.

We have found that the synergistic effects achieved by optimizing certain essential conditions in a golf ball serve to increase the distance traveled by the ball, provide the ball with excellent spin performance when hit with an iron and on approach shots, and endow the ball with good cracking resistance, good durability to topping, good scuff resistance and a good feel upon impact, resulting in the exceptional performance desired in particular by professionals and other skilled golfers.

Accordingly, the invention provides a solid multi-piece golf ball having a solid elastic core, a cover composed of at least one layer enclosing the core, and an intermediate layer composed of a thermoplastic material between the core and the cover. The core, when subjected to a load of 1274 N (130 kgf) from an initial load of 98 N (10 kgf), undergoes a deformation of 3.2 to 6.5 mm. The cover has a Shore D hardness of 45 to 55 and the intermediate layer has a Shore D hardness in a range of 54 to 65 and higher than the Shore D hardness of the cover. The cover and the intermediate layer have a combined thickness, defined as (cover thickness+intermediate layer thickness), of 2.3 to 3.5 mm. The cover and the intermediate layer have a thickness ratio, defined as (cover thickness)/(intermediate layer thickness), of 0.48 to 0.84.

Preferably, the cover is composed primarily of a material selected from the group consisting of thermoplastic and thermoset polyurethane elastomers, polyester elastomers, ionomer resins, polyolefin elastomers and mixtures thereof.

The intermediate layer is typically made of a resin composition containing at least 30 parts by weight of ionomer resin, which resin composition preferably includes:

(a) 100 parts by weight of an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) 5 to 80 parts by weight of a fatty acid having a molecular weight of at least 280 or a derivative thereof; and (c) 0.1 to 10 parts by weight of a basic inorganic metal compound capable of neutralizing the acid groups within components (a) and (b).

In one preferred embodiment, the golf ball of the invention has an adhesive layer between the cover and the intermediate layer.

BRIEF DESCRIPTION OF THE DIAGRAM

FIG. 1 is a sectional view showing a golf ball according to one embodiment of the invention.

DETAILED DESCRIPTION OF THE INVENTION

The solid multi-piece golf ball of the invention has a construction composed of at least three layers which include, as in the three-piece golf ball G shown in FIG. 1, a solid elastic core 1, a cover 2, and an intermediate layer 3.

The solid elastic core may be produced from a known material, and is preferably made of a rubber composition. The rubber composition is preferably one in which polybutadiene is used as the base material. 1,4-Polybutadiene having a cis structure of at least 40% is preferred. If desired, other rubbers such as a natural rubber, polyisoprene rubber or styrene-butadiene rubber may be suitably blended into the above base rubber. The rebound energy of the golf ball can be improved by increasing the amount of the rubber components.

Curing agents that may be compounded in the rubber composition include the zinc and magnesium salts of unsaturated fatty acids, such as zinc methacrylate and zinc acrylate, and ester compounds such as trimethylolpropane methacrylate. The use of zinc acrylate is especially preferred. It is advantageous to include such a curing agent in an amount of at least 10 parts by weight, and preferably at least 20 parts by weight, but not more than 50 parts by weight, and preferably not more than 39 parts by weight, per 100 parts by weight of the base rubber.

A crosslinking agent is generally compounded in the rubber composition. It is recommended that the crosslinking agent include a peroxide having a one minute half-life temperature of not more than 155° C. in an amount of at least 20% by weight, and preferably at least 30 wt %, based on the overall amount of crosslinking agent. Although there is no particular upper limit on the amount of peroxide used, an amount no greater than 70 wt % is preferred. Examples of suitable peroxides include commercially available products such as Perhexa 3M (manufactured by Nippon Oils and Fats Co., Ltd.) and Luperco 231XL (manufactured by Atochem Co.). It is advantageous for the amount of crosslinking agent included in the rubber composition to be at least 0.2 part by weight, and especially at least 0.6 part by weight, but not more than 2.0 parts by weight, and especially not more than 1.5 parts by weight.

If necessary, other suitable ingredients may also be incorporated in the rubber composition, such as antioxidants and fillers (e.g., zinc oxide, barium sulfate) for modifying the specific gravity.

It is particularly advantageous to include an organosulfur compound in the rubber composition. Exemplary compounds for this purpose include thiophenols, thionaphthols, halogenated thiophenols, and metal salts thereof. Specific examples of suitable organosulfur compounds include halogenated thiophenols such as pentachlorothiophenol, pentafluorothiophenol, pentabromothiophenol, p-chlorothiophenol and the zinc salt of pentachlorothiophenol; and polysulfides having two to four sulfur atoms, such as diphenyl polysulfides, dibenzyl polysulfides, dibenzoyl polysulfides, dibenzothiazoyl polysulfides and dithiobenzoyl polysulfides. The zinc salt of pentachlorothiophenol and diphenyl disulfide are especially preferred. Such an organosulfur compound is typically included in an amount of at least 0.3 parts by weight, and preferably at least 0.5 parts by weight, but not more than 2.0 parts by weight, and preferably not more than 1.2 parts by weight, per 100 parts by weight of the base rubber. Too little of this ingredient tends to lower the rebound energy and the core hardness, whereas too much may make the core excessively soft, deadening the feel of the ball on impact and worsening its durability (cracking resistance) when repeatedly struck with a club.

The rubber composition may be vulcanized and cured by a known method to form the solid core. It is recommended that the solid core be formed to a diameter of at least 35.6 mm, preferably at least 36 mm, and most preferably at least 36.2 mm, but not more than 39 mm, preferably not more than 38 mm, and most preferably not more than 37 mm.

The solid elastic core in the golf ball of the invention has a deformation, when the load is increased from an initial load state of 98 N (10 kgf) to 1274 N (130 kgf), of at least 3.2 mm, preferably at least 3.4 mm, and most preferably at least 3.6 mm, but not more than 6.5 mm, and preferably not more than 4.1 mm. Too little deformation gives the ball a poor feel on impact and excessively increases spin, particularly on long shots with a driver normally associated with considerable deformation, thus preventing the desired travel from being achieved. On the other hand, too much deformation may deaden the feel and make it impossible to achieve the necessary rebound energy, again preventing the desired travel from being achieved. Excessive deformation may also result in poor cracking resistance with repeated use of the ball.

It is recommended that the solid core have a specific gravity of generally at least 1.00, preferably at least 1.05, and more preferably at least 1.10, but not more than 1.30, preferably not more than 1.25, and most preferably not more than 1.20.

The intermediate layer of the inventive golf ball is not subject to any particular limitation, provided it satisfies the subsequently described optimized relationship with the cover thickness and has the requisite hardness. It is desirable for the material making up the intermediate layer to be a resin composition which includes at least 30 parts by weight, and preferably at least 50 parts by weight, of ionomer resin.

The intermediate layer material is preferably a resin composition containing components (a) to (c) below as the essential constituents:

(a) an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) a fatty acid having a molecular weight of at least 280 or a derivative thereof; and (c) a basic inorganic metal compound capable of neutralizing the acid groups within components (a) and (b).

The resin composition in which above components (a) to (c) serve as the essential constituents has a good thermal stability, flow properties and moldability, and is capable of imparting excellent rebound characteristics to the intermediate layer.

Olefins which may serve as component (a) generally have at least 2 carbons. The upper limit in the number of carbons is generally 8, and preferably 6. Examples of suitable olefins include ethylene, propylene, butene, pentene, hexene, heptene and octene. Ethylene is especially preferred.

Examples of suitable unsaturated carboxylic acids include acrylic acid, methacrylic acid, maleic acid and fumaric acid. Acrylic acid and methacrylic acid are especially preferred.

Suitable unsaturated carboxylic acid esters include lower alkyl esters of the above-described unsaturated carboxylic acids. Specific examples include methyl methacrylate, ethyl methacrylate, propyl methacrylate, butyl methacrylate, methyl acrylate, ethyl acrylate, propyl acrylate and butyl acrylate. Of these, butyl acrylate (n-butyl acrylate, i-butyl acrylate) is especially preferred.

Random copolymers which may serve as component (a) can be prepared by random copolymerization of the foregoing ingredients according to a known method. It is recommended that the amount of unsaturated carboxylic acid included in the random copolymer, also referred to below as the "acid content," be generally at least 2% by weight, preferably at least 6% by weight, and most preferably at least 8% by weight, but not more than 25% by weight, preferably not more than 20% by weight, and most preferably not more than 15% by weight. At too low an acid content, the rebound energy may decrease, whereas too high an acid content may result in a decline in durability.

Random polymer neutralization products which may serve as component (a) can be prepared by partially neutralizing the acid groups on the random copolymer with metal ions. Suitable examples of metal ions for neutralizing the acid groups include $Na^+$, $K^+$, $Li^+$, $Zn^{2+}$, $Cu^{2+}$, $Mg^{2+}$, $Ca^{2+}$, $Co^{2+}$ $Ni^{2+}$ and $Pb^{2+}$. Of these, $Na^+$, $Li^+$, $Zn^{2+}$ and $Mg^{2+}$ are preferred, and $Zn^{++}$ is especially preferred. The degree to which the random copolymer is neutralized by these metal ions is not subject to any particular limitation. Such neutralization products may be prepared by a known method, such as one involving the use of a compound containing the metal ion to be introduced onto the random copolymer, such as a formate, acetate, nitrate, carbonate, bicarbonate, oxide, hydroxide or alkoxide thereof.

In working the invention, the intermediate layer material is prepared by blending predetermined amounts of components (b) and (c) with the base resin serving as component (a). It is recommended that at least 50 mol %, preferably at least 60 mol %, more preferably at least 70 mol %, and most preferably at least 80 mol %, of the acid groups in the resulting mixture be neutralized. A higher degree of neutralization more reliably suppresses the undesirable exchange reactions that arise with use of the base resin and a fatty acid (derivative) alone, making it possible to preclude regeneration of fatty acid and achieve a material having a greatly increased thermal stability, a good moldability and a much higher resilience than conventional ionomer resins.

Illustrative examples of component (a) include Nucrel AN4311, AN4318 and AN1560 (all produced by DuPont-Mitsui Polychemicals Co., Ltd.); Himilan 1554, 1557, 1601, 1605, 1706, 1855, 1856 and AM7316 (all products of DuPont-Mitsui Polychemicals Co., Ltd.); and Surlyn 6320, 7930, 8120, 8940, 9910, 9945 and 8945 (all products of E.I. DuPont de Nemours and Company). Zinc ion-neutralized ionomer resins, such as Himilan AM7316, are especially preferred.

Component (b) is a fatty acid or fatty acid derivative with a molecular weight of at least 280. This component, which has a much lower molecular weight than component (a), enhances the flow characteristics of the resin composition and greatly increases the melt viscosity of the intermediate layer material. Also, because the fatty acid or fatty acid derivative has a molecular weight of at least 280 and a high content of acid groups or derivative moieties thereof, it is able to suppress the loss of rebound by the golf ball.

The fatty acid or fatty acid derivative of component (b) may be an unsaturated fatty acid or fatty acid derivative thereof having a double bond or triple bond in the alkyl group, or it may be a saturated fatty acid or fatty acid derivative in which all the bonds on the alkyl group are single bonds. It is recommended that the number of carbons on the molecule be generally at least 18, preferably at least 20, and most preferably at least 22, but not more than 80, preferably not more than 60, more preferably not more than 40, and most preferably not more than 30. Too few carbons may make it impossible to achieve an improved heat resistance, and may also set the acid group content so high as to cause the acid groups to interact with acid groups present in component (a), diminishing the flow-enhancing effect. On the other hand, too many carbons increases the molecular weight, which may also lower the flow-enhancing effect.

Specific examples of fatty acids that may be used as component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

Fatty acid derivatives which may be used as component (b) include derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^{+}Ca^{2+}Mg^{2+}$, $Zn^{2+}Mn^{2+}$, $Al^{3+}$, $Ni^{2+}$, $Fe^{2+}$, $Fe^{3+}$, $Cu^{2+}$, $Sn^{2+}$, $Pb^{2+}$ and $Co^{2+}$. Of these, $Ca^{2+}$, $Mg^{2+}$ and $Zn^{2+}$ are preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (c) is a basic inorganic metal compound capable of neutralizing the acid groups in above components (a) and (b).

For the purposes of the present invention, component (c) may be any basic inorganic metal compound capable of neutralizing the acid groups in above components (a) and (b). However, the use of a hydroxide is especially desirable because the high reactivity of hydroxides and the absence of organic compounds in the reaction by-products enable the degree of neutralization in the intermediate layer material to be increased without a loss of thermal stability.

Metal ions that may be used in the basic inorganic metal compound include $Li^{+}$, $Na^{+}$, $K^{+}$, $Ca^{2+}$, $Mg^{2+}$, $Zn^{2+}$, $Al^{3+}$, $Ni^{2+}$, $Fe^{2+}$, $Fe^{3+}$, $Cu^{2+}$, $Mn^{2+}$, $Sn^{2+}$, $Pb^{2+}$ and $Co^{2+}$. Examples of suitable inorganic metal compounds include basic inorganic metal compounds containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a hydroxide is preferred. The use of calcium hydroxide, which has a high reactivity with component (a), and especially ionomer resins, is most preferred.

A known mixing method may be employed to prepare the intermediate layer material for the inventive golf ball. However, when above components (a) to (c) are compounded, it is recommended that they be combined in relative proportions of 100 parts by weight of component (a); generally at least 5 parts by weight, but not more than 80 parts by weight, preferably not more than 40 parts by weight, and most preferably not more than 20 parts by weight, of component (b); and at least 0.1 part by weight, but not more than 10 parts by weight, and preferably not more than 5 parts by weight, of component (c). Too little component (b) lowers the melt viscosity, resulting in a poor processability. Too little component (c) fails to improve thermal stability and rebound, whereas too much actually lowers the heat resistance of the composition due to the presence of excess basic inorganic metal compound.

It is suggested that the intermediate layer have a specific gravity of at least 0.8, preferably at least 0.9, and most preferably at least 0.93, but not more than 1.5, preferably not more than 1.2, and most preferably not more than 1.05.

Referring to the solid multi-piece golf ball G shown in FIG. 1, the intermediate layer of the inventive golf ball has a thickness 4 which extends radially from the core surface to the outer surface of the intermediate layer. It is recommended that the intermediate layer thickness be generally at least 1.2 mm, and preferably at least 1.6, but not more than 2.4 mm, and preferably not more than 1.9 mm. It is essential that the intermediate layer be optimized with the subsequently described thickness of the cover.

The intermediate layer of the golf ball according to the invention has an optimized Shore D hardness. The Shore D hardness will be described later.

No particular limitation is imposed on the cover of the solid multi-piece golf ball of the invention, although a cover made of a suitable material, such as one composed primarily of a thermoplastic resin or a thermoset resin, is preferred. Suitable examples of the principal material in the cover include thermoplastic or thermoset polyurethane elastomers, polyester elastomers, ionomer resins and polyolefin elastomers. These materials may be used alone or as a mixture of two or more thereof. If necessary, a filler such as barium sulfate may be added and used in the cover material. The use of a thermoplastic polyurethane elastomer is recommended because it provides the cover with an excellent scuffing resistance and outstanding manufacturability.

A thermoplastic polyurethane elastomer having a tan $\delta$ peak temperature, in the measurement of viscoelasticity, not higher than −15° C., and especially not higher than −16° C., but not lower than −50° C., is preferred from the standpoint of flexibility and rebound characteristics.

The cover material used in the invention may be a reaction product between the above-described thermoplastic polyurethane elastomer and an isocyanate compound. A material of this type makes it possible to further enhance the surface durability when the ball is hit with an iron.

Commercial products that may be used as the thermoplastic polyurethane elastomer include those in which the diisocyanate is aliphatic, such as Pandex T7298, T7295, T7890 and TR3080 (all manufactured by DIC Bayer Polymer, Ltd.). Examples of commercial ionomer resins that may be used in the cover material include Surlyn 6320, Himilan 1855 and Surlyn 8120.

Optional ingredients that may also be incorporated into the above-described principal material of which the cover is made include polymers such as thermoplastic elastomers other than those mentioned above. Examples of such polymers that may be incorporated as optional ingredients include polyamide elastomers, styrene block elastomers, hydrogenated polybutadiene, and ethylene-vinyl acetate (EVA) copolymers.

Regardless which of the above materials is used in the cover of the inventive golf ball, it is desirable to adjust the specific gravity of the cover stock. It is recommended that the cover stock have a specific gravity of generally at least 0.9, and preferably at least 1, but not more than 1.3, and preferably not more than 1.22. Setting the specific gravity to a value of at least 1 makes it possible to increase the golf ball's moment of inertia, giving the ball excellent spin retention during flight. As a result, in shots with a driver or a long iron, the ball does not undergo an excessive decrease in spin until the time of descent, thus providing a final extension of the trajectory and making it possible to increase the carry of the ball.

It is advantageous for the cover to have a thickness of at least 0.7 mm, and preferably at least 1.0 mm, but not more than 1.6 mm, and preferably not more than 1.2 mm. As shown in FIG. 1, the cover thickness 5 refers to the thickness extending radially from the surface of intermediate layer 3 to land areas, or areas free of dimples D, on the cover's surface.

In the golf ball of the invention, the intermediate layer and the cover have a combined thickness, defined as (cover thickness+intermediate layer thickness), of at least 2.3 mm, and preferably at least 2.5 mm, but not more than 3.5 mm, and preferably not more than 3.3 mm. Too small a combined thickness results in poor cracking resistance when the ball is repeatedly hit, whereas too large a combined thickness lowers the rebound energy of the ball, resulting in a shorter carry.

Moreover, the cover and the intermediate layer in the inventive golf ball have a thickness ratio, defined as (cover thickness)/(intermediate layer thickness), of at least 0.48, and preferably at least 0.53, but not more than 0.84, and preferably not more than 0.78. At a thickness ratio which is too small, durability when the ball is topped during a shot with an iron decreases excessively and scuffing resistance worsens. On the other hand, too large a thickness ratio lowers the rebound energy and also worsens the cracking resistance of the ball when repeatedly hit.

In the practice of the invention, it is essential to optimize the Shore D hardnesses of the intermediate layer and the cover. The intermediate layer has a Shore D hardness of at least 54, preferably at least 57, and most preferably at least 59, but not more than 65, preferably not more than 63, and most preferably not more than 61. Too soft an intermediate layer has the effect of increasing the spin rate when the ball is shot with various clubs, resulting in a shorter carry and an excessively soft feel upon impact. On the other hand, an intermediate layer that is too hard lowers the spin rate, reducing controllability. In addition, it gives the golf ball a hard feel on impact and lowers the ball's cracking resistance when repeatedly hit.

The cover has a Shore D hardness of at least 45, preferably at least 47, and most preferably at least 50, but not more than 55, and preferably not more than 53. The cover must have a lower Shore D hardness than the intermediate layer. Too soft a cover has the effect of increasing the spin rate when the ball is shot with various clubs, resulting in a shorter carry and an excessively soft feel upon impact. On the other hand, a cover that is too hard lowers the spin rate, reducing controllability. In addition, it gives the golf ball a hard feel on impact and lowers the ball's cracking resistance when repeatedly hit.

In the practice of the invention, the cover must be formed to a lower hardness than the intermediate layer. It is recommended that the cover and the intermediate layer have a difference in Shore D hardness of generally at least 2, preferably at least 5, more preferably at least 7, and most preferably at least 9, but not more than 30, preferably not more than 25, and most preferably not more than 20. A hardness difference that is too small tends to make the ball overly receptive to spin, resulting in a shorter carry. On the other hand, an excessive hardness difference tends to lower the durability of the ball.

If necessary, an adhesive layer may be provided between the intermediate layer and the cover to improve adhesion between the intermediate layer and the cover, and to enhance durability at the time of impact. Examples of suitable adhesives include epoxy resin adhesives, vinyl resin adhesives and rubber-based adhesives, although the use of a urethane resin-based adhesive or a chlorinated polyolefin-based adhesive is especially preferred. Commercial products that are well-suited for this purpose include Resamine D6208 (a urethane resin-based adhesive manufactured by Dainichi Seika Colour & Chemicals Mgf. Co., Ltd.) and RB182 Primer (a chlorinated polyolefin-based adhesive manufactured by Nippon Bee Chemical Co., Ltd.).

The adhesive layer may be formed by dispersion coating. No particular limitation is imposed on the type of emulsion used for dispersion coating. The resin powder used for preparing the emulsion may be a thermoplastic resin powder or a thermoset resin powder. Illustrative examples of suitable resins include vinyl acetate resin, vinyl acetate copolymer resins, ethylene-vinyl acetate (EVA) copolymer resins, acrylate polymer or copolymer resins, epoxy resins, thermoset urethane resins, and thermoplastic urethane resins. Of these, epoxy resins, thermoset urethane resins, thermoplastic urethane resins and acrylate polymers or copolymers are preferred. A thermoplastic urethane resin is especially preferred.

It is desirable for the adhesive layer to have a thickness of at least 0.1 $\mu$m, preferably at least 0.2 $\mu$m, and most preferably at least 0.3 $\mu$m, but not more than 30 $\mu$m, preferably not more than 25 $\mu$m, and most preferably not more than 20 $\mu$m.

Any suitable known process may be used to manufacture the solid multi-piece golf ball of the invention. For ease of operation and other reasons, it is especially advantageous to make use of a process in which the solid elastic core is molded under pressure and vulcanized, following which the molded core is placed in an injection mold and the intermediate layer material and the cover material are successively injected over the core in accordance with a selected technique to form an intermediate layer and a cover.

The solid multi-piece golf ball of the invention can be manufactured such as to have a diameter and weight which conform with the Rules of Golf for competitive use. That is, the ball may be given a diameter of at least 42.67 mm and a weight of not more than 45.93 g.

The inventive golf ball provides increased carry and has excellent spin characteristics on shots with an iron and on approach shots. In addition, it has a good cracking resistance when repeatedly hit, good durability to topping, good scuff resistance, and a good feel on impact. This combination of qualities provides the golf ball with the excellent performance desired in particular by professionals and other skilled golfers.

EXAMPLES

Examples of the invention and comparative examples are given below by way of illustration, and are not intended to limit the invention.

Examples 1 to 4, and Comparative Examples 1 to 10

Solid elastic cores having the respective diameters and deformations shown in Table 3 were produced from the core materials shown in Table 1.

Solid three-piece golf balls having the intermediate layers and covers shown in Table 3 and bearing the same arrangement of dimples in three types of differing diameter and depth were manufactured using resin materials having the compositions shown in Table 2 as the intermediate layer material and the cover material over the resulting solid elastic cores.

The materials mentioned in the tables are described below.

Polybutadiene (1): BR11, manufactured by JSR Corporation.

Polybutadiene (2): BR18, manufactured by JSR Corporation.

Peroxide (1): Dicumyl peroxide, manufactured by NOF Corporation under the trade name Percumil D.

Peroxide (2): 40% Dilution of 1,1-bis(t-butylperoxy)-3,3,5-trimethylcyclohexane, manufactured by NOF Corporation under the trade name Perhexa 3M-40.

Antioxidant: Produced by Ouchi Shinko Chemical Industry Co., Ltd. under the trade name Nocrack NS-6.

Adhesive: RB-182 Primer, produced by Nippon Bee Chemical Co., Ltd.

Thickness to which adhesive layer was formed: 3 $\mu$m

Himilan: An ionomer resin manufactured by DuPont-Mitsui Polychemicals Co., Ltd.

AM7315: A zinc ionomer resin produced by DuPont-Mitsui Polychemicals Co., Ltd. Acid content, 20%.

AM7318: A sodium ionomer resin produced by DuPont-Mitsui Polychemicals Co., Ltd. Acid content, 18%.

Nucrel: An ethylene-methacrylic acid-acrylate copolymer made by DuPont-Mitsui Polychemicals Co., Ltd.

Pandex: A thermoplastic polyurethane elastomer manufactured by Dainippon Ink & Chemicals, Inc.

Behenic acid: NAA222-S beads produced by NOF Corporation.

Calcium hydroxide: CLS-B produced by Shiraishi Kogyo Co., Ltd.

The properties of the golf balls obtained in the examples were measured or evaluated as described below.

Core Hardness:

Measured as the deformation (mm) by the core under loading from 98 to 1274 N.

Flight Performance:

Rated as follows, based on the carry of the ball when it was struck at a head speed of 50 m/s with a driver (number one wood, #1W) mounted on a swing machine.

Good: 250 m or more

Poor: less than 250 m

Spin When Hit with Sand Wedge on Approach Shot:

Rated as follows, based on the spin rate of the ball when it was struck at a head speed of 20 m/s with a sand wedge (SW) mounted on a swing machine.

Good: 6,000 rpm or more

Fair: at least 5,500 rpm but less than 6,000 rpm

Poor: less than 5,500 rpm

Feel:

The feel of the ball when hit with various clubs (driver, sand wedge, putter) was rated as follows by three professional golfers.

Good: Good feel on impact

Poor: Too hard or too soft

Durability When Repeatedly Hit:

Each ball was repeatedly hit at a head speed of 50 m/s with a driver (number one wood) mounted on a swing machine until the initial speed of the ball declined. The number of times a ball had been hit when the rebound energy successively fell 3% was rated as follows, based on a durability value of 100 for the ball produced in Example 4.

Good: At least 100 (can be used at least as many times as Example 4 balls)

Poor: Less than 100 (durability lower than that of Example 4 balls)

Scuff Resistance:

A ball was struck once at a head speed of 45 m/s with a pitching wedge mounted in a swing machine, and the degree of scuffing incurred by the ball was visually evaluated. Three judges were used to rate the balls. A rating of "Good" indicates that at least two of the judges felt the ball could be used again, and a rating of "Poor" indicates that one or none of the judges felt the ball could be used again.

Good: Ball can be used again

Poor: Ball cannot be reused

Durability When Topped With an Iron:

The swing machine was set to a somewhat lower ball position than in the above scuff resistance test, and the ball was topped with an iron at a head speed of 45 m/s. The durability was rated in the same way as for the scuff resistance.

Good: Ball can be used again

Poor: Ball cannot be reused

TABLE 1

| | Example | | | | Comparative Example | | | | | | | | | |
|---|---|---|---|---|---|---|---|---|---|---|---|---|---|---|
| | 1 | 2 | 3 | 4 | 1 | 2 | 3 | 4 | 5 | 6 | 7 | 8 | 9 | 10 |
| Core formulation (parts by weight) | | | | | | | | | | | | | | |
| Polybutadiene (1) | 50 | 50 | 50 | 50 | 50 | 50 | 50 | 50 | 50 | 50 | 50 | 50 | 50 | 50 |
| Polybutadiene (2) | 50 | 50 | 50 | 50 | 50 | 50 | 50 | 50 | 50 | 50 | 50 | 50 | 50 | 50 |

TABLE 1-continued

| | Example | | | | Comparative Example | | | | | | | | | |
|---|---|---|---|---|---|---|---|---|---|---|---|---|---|---|
| | 1 | 2 | 3 | 4 | 1 | 2 | 3 | 4 | 5 | 6 | 7 | 8 | 9 | 10 |
| Zinc acrylate | 29.5 | 31.5 | 31.0 | 29.5 | 31.5 | 25.5 | 27.5 | 29.5 | 35.0 | 16.0 | 29.5 | 26.5 | 24.5 | 29.5 |
| Peroxide (1) | 0.6 | 0.6 | 0.6 | 0.6 | 0.6 | 0.6 | 0.6 | 0.6 | 0.6 | 0.6 | 0.6 | 0.6 | 0.6 | 0.6 |
| Peroxide (2) | 0.6 | 0.6 | 0.6 | 0.6 | 0.6 | 0.6 | 0.6 | 0.6 | 0.6 | 0.6 | 0.6 | 0.6 | 0.6 | 0.6 |
| Antioxidant | 0.2 | 0.2 | 0.2 | 0.2 | 0.2 | 0.2 | 0.2 | 0.2 | 0.2 | 0.2 | 0.2 | 0.2 | 0.2 | 0.2 |
| Zinc oxide | 19.7 | 18.9 | 19.1 | 19.7 | 18.9 | 30.2 | 10.6 | 19.2 | 30.9 | 25.3 | 19.7 | 18.9 | 18.0 | 21.5 |
| Zinc salt of pentachlorothio phenol | 1 | 1 | 1 | 1 | 1 | 0 | 0.5 | 0.5 | 1 | 1 | 1 | 1 | 0.5 | 1 |
| Zinc stearate | 5 | 5 | 5 | 5 | 5 | 0 | 0 | 0 | 5 | 5 | 5 | 5 | 0 | 5 |
| Vulcanization conditions | | | | | | | | | | | | | | |
| Temperature (° C.) | 157 | 157 | 157 | 157 | 157 | 157 | 157 | 157 | 157 | 157 | 157 | 157 | 157 | 157 |
| Time (minutes) | 15 | 15 | 15 | 15 | 15 | 15 | 15 | 15 | 15 | 20 | 15 | 15 | 15 | 15 |

TABLE 2

| | (1) | (2) | (3) | (4) | (5) | (6) | (7) | (8) | (9) | (10) |
|---|---|---|---|---|---|---|---|---|---|---|
| Formulation (parts by weight) | | | | | | | | | | |
| Himilan 1706 | 42.5 | | | 50 | | | | | | |
| Himilan 1557 | | 50 | 50 | | | | | | | |
| AM7315 | | | | | | | | | | 50 |
| AM7318 | | | | | | | | | | 50 |
| Himilan 1605 | 42.5 | | | 50 | | | | | | |
| Himilan 1601 | | 50 | 50 | | | | | | | |
| Hytrel 4047 | | | | | | | | | 100 | |
| Nucrel AN4318 | 15 | | | | | | | | | |
| Pandex T-7298 | | | | | 100 | 75 | 50 | | | |
| Pandex T-R3080 | | | | | | 25 | 50 | 100 | | |
| Behenic acid | 20 | 20 | | | | | | | | |
| Calcium hydroxide | 2.8 | 2.8 | | | | | | | | |
| Titanium dioxide | | | 2.4 | 4.8 | 4 | 4 | 4 | 4 | | 3.6 |
| Dicyclohexyl-methane-4,4'-diisocyanate | | | | | 1.5 | 1.5 | 1.5 | 1.5 | | |
| Specific gravity | 0.96 | 0.96 | 0.96 | 0.98 | 1.18 | 1.18 | 1.18 | 1.18 | 1.12 | 0.97 |
| Shore D hardness | 61 | 60 | 60 | 63 | 50 | 47 | 45 | 40 | 40 | 66 |

TABLE 3

| | Example | | | | Comparative Example | | | | | | | | | |
|---|---|---|---|---|---|---|---|---|---|---|---|---|---|---|
| | 1 | 2 | 3 | 4 | 1 | 2 | 3 | 4 | 5 | 6 | 7 | 8 | 9 | 10 |
| Solid core | | | | | | | | | | | | | | |
| Diameter (mm) | 36.46 | 36.44 | 36.44 | 36.46 | 36.44 | 36.46 | 36.46 | 36.44 | 36.46 | 36.46 | 36.46 | 36.40 | 38.50 | 35.50 |
| Hardness (when loaded from 98 N to 1274 N) (mm) | 3.9 | 3.6 | 3.7 | 3.9 | 3.6 | 3.9 | 3.9 | 3.6 | 2.9 | 7.0 | 3.9 | 4.5 | 4.5 | 3.9 |
| Intermediate layer | | | | | | | | | | | | | | |
| Type of intermediate layer material | (1) | (1) | (2) | (1) | (7) | (4) | (9) | (10) | (7) | (7) | (4) | (1) | (2) | (7) |
| Shore D hardness of intermediate layer | 61 | 61 | 60 | 61 | 60 | 63 | 40 | 66 | 60 | 60 | 63 | 61 | 60 | 60 |
| Thickness of intermediate layer (mm) | 2.00 | 1.81 | 2.01 | 1.80 | 1.81 | 1.80 | 2.00 | 1.81 | 2.00 | 1.80 | 2.32 | 1.65 | 1.25 | 2.07 |
| Solid core + intermediate layer Diameter (mm) | 40.45 | 40.06 | 40.45 | 40.05 | 40.06 | 40.05 | 40.45 | 40.06 | 40.45 | 40.05 | 41.10 | 39.70 | 41.00 | 39.63 |
| Adhesive layer between cover | yes | yes | yes | yes | yes | no | yes | yes | yes | yes | yes | yes | yes | yes |

TABLE 3-continued

| | Example | | | | Comparative Example | | | | | | | | | |
|---|---|---|---|---|---|---|---|---|---|---|---|---|---|---|
| | 1 | 2 | 3 | 4 | 1 | 2 | 3 | 4 | 5 | 6 | 7 | 8 | 9 | 10 |
| and intermediate layer | | | | | | | | | | | | | | |
| Cover | | | | | | | | | | | | | | |
| Type of material | (6) | (5) | (5) | (6) | (8) | (3) | (7) | (5) | (7) | (5) | (5) | (5) | (6) | (7) |
| Thickness (mm) | 1.13 | 1.31 | 1.13 | 1.33 | 1.33 | 1.33 | 1.13 | 1.32 | 1.13 | 1.33 | 0.80 | 1.50 | 0.85 | 1.54 |
| Shore D hardness | 47 | 50 | 50 | 47 | 40 | 60 | 45 | 50 | 45 | 50 | 50 | 50 | 47 | 45 |
| Ball | | | | | | | | | | | | | | |
| Diameter (mm) | 42.70 | 42.68 | 42.70 | 42.71 | 42.70 | 42.71 | 42.70 | 42.70 | 42.70 | 42.70 | 42.70 | 42.70 | 42.70 | 42.70 |
| Weight (g) | 45.4 | 45.5 | 45.4 | 45.6 | 45.6 | 45.6 | 45.4 | 45.7 | 45.4 | 45.6 | 45.2 | 45.5 | 45.4 | 45.7 |
| Cover and intermediate layer | | | | | | | | | | | | | | |
| Cover thickness/ intermediate layer thickness | 0.56 | 0.72 | 0.56 | 0.74 | 0.73 | 0.74 | 0.56 | 0.73 | 0.56 | 0.74 | 0.34 | 0.91 | 0.68 | 0.74 |
| Combined thickness (cover + intermediate layer) (mm) | 3.12 | 3.12 | 3.13 | 3.13 | 3.14 | 3.13 | 3.12 | 3.13 | 3.12 | 3.12 | 3.12 | 3.15 | 2.10 | 3.60 |
| Ball performance #1W (HS = 50) | | | | | | | | | | | | | | |
| Carry (m) | 234.0 | 236.9 | 237.4 | 233.5 | 230.0 | 232.3 | 234.1 | 237.1 | 234.2 | 224.9 | 235.1 | 212.2 | 232.5 | 231.8 |
| Total distance (m) | 255.8 | 256.0 | 256.8 | 255.0 | 248.0 | 256.5 | 248.8 | 257.5 | 253.8 | 245.2 | 256.5 | 253.5 | 255.0 | 249.5 |
| Spin (rpm) | 2626 | 2729 | 2714 | 2556 | 3185 | 2078 | 3096 | 2629 | 3059 | 2156 | 2491 | 2819 | 2720 | 2836 |
| Flight performance rating | good | good | good | good | poor | good | poor | good | good | poor | good | good | good | poor |
| SW (HS = 20) | | | | | | | | | | | | | | |
| Spin rate (rpm) | 6040 | 6133 | 6005 | 6074 | 6895 | 5352 | 6920 | 5753 | 7069 | 5270 | 5735 | 5890 | 5990 | 6314 |
| Spin rating | good | good | good | good | good | poor | good | fair | good | poor | fair | good | good | good |
| Feel | | | | | | | | | | | | | | |
| Number one wood | good | good | good | good | good | good | good | good | poor | poor | good | good | good | good |
| Pitching wedge | good | good | good | good | good | poor | good | good | poor | poor | good | good | good | good |
| Putter | good | good | good | good | poor | poor | poor | poor | good | poor | poor | good | good | good |
| Durability | | | | | | | | | | | | | | |
| Durability until rebound energy drops when ball is repeatedly hit | good | good | good | good | good | good | good | poor | good | poor | good | poor | poor | good |
| Scuffing resistance | good | good | good | good | good | good | good | poor | good | good | poor | good | good | good |
| Durability when topped with iron | good | good | good | good | good | good | good | good | good | good | poor | good | good | good |

As is apparent from the results in Table 3, the golf balls according to the invention all had an excellent flight performance, excellent approach shot characteristics, a good feel when hit with different types of clubs, excellent durability, and a good spin performance. By contrast, the golf balls obtained in the comparative examples had the following drawbacks.

Comparative Example 1: The cover was too soft. The ball thus incurred too much spin when hit with a driver, resulting in a poor flight performance.

Comparative Example 2: The cover was too hard. The ball did not incur enough spin on approach shots, resulting in poor controllability.

Comparative Example 3: The intermediate layer was too soft. The ball thus incurred too much spin when hit with a driver, resulting in a poor flight performance.

Comparative Example 4: The intermediate layer was too hard, as a result of which the ball sometimes had a hard feel upon impact. In addition, the ball had a poor scuffing resistance and poor cracking resistance when repeatedly hit.

Comparative Example 5: The core was too hard, giving the ball a hard feel upon impact during shots with a driver or a pitching wedge.

Comparative Example 6: The core was too soft, deadening the feel of the ball and also lowering the rebound energy so that the ball had a poor carry when hit with a driver.

Comparative Example 7: The (cover thickness)/(intermediate layer thickness) ratio was too small, giving the ball a hard feel when hit with a putter. In addition, the ball had a poor scuffing resistance and a poor cracking resistance when topped with an iron.

Comparative Example 8: The (cover thickness)/(intermediate layer thickness) ratio was too large. As a result, the ball had a poor cracking resistance when repeatedly hit.

Comparative Example 9: The combined thickness of the cover and the intermediate layer was too low. As a result, the ball had a low cracking resistance when repeatedly hit.

Comparative Example 10: The combined thickness of the cover and the intermediate layer was too high, lowering the rebound energy so that the ball had a poor carry when hit with a driver.

Japanese Patent Application No. 2001-125715 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid multi-piece golf ball comprising a solid elastic core, a cover composed of at least one layer enclosing the core, and an intermediate layer composed of a thermoplastic material between the core and the cover; wherein the core, when subjected to a load of 1274 N (130 kgf) from an initial load of 98 N (10 kgf), undergoes a deformation of 3.2 to 6.5 mm;

the cover has a Shore D hardness of 45 to 55 and the intermediate layer has a Shore D hardness in a range of 54 to 65 and higher than the Shore D hardness of the cover;

the cover and the intermediate layer have a combined thickness, defined as (cover thickness+intermediate layer thickness), of 2.3 to 3.5 mm; and the cover and the intermediate layer have a thickness ratio, defined as (cover thickness)/(intermediate layer thickness), of 0.48 to 0.84, wherein the intermediate layer is made of a resin composition containing at least 30 parts by weight of ionomer resin, said resin composition including:

(a) 100 parts by weight of an olefin/unsaturated carboxylic acid random copolymer, an olefin/unsaturated carboxylic acid/unsaturated carboxylic acid ester random copolymer, a metal ion neutralization product of either type of copolymer, or a mixture of any of the copolymers and the neutralization products thereof;

(b) 5 to 80 parts by weight of a fatty acid having a molecular weight of at least 280 or a derivative thereof; and (c) 0.1 to 10 parts by weight of a basic inorganic metal compound capable of neutralizing the acid groups in components (a) and (b).

2. The golf ball of claim 1, wherein the cover is composed primarily of a material selected from the group consisting of thermoplastic and thermoset polyurethane elastomers, polyester elastomers, ionomer resins, polyolefin elastomers and mixtures thereof.

3. The golf ball of claim 1 which has an adhesive layer between the cover and the intermediate layer.

4. The golf ball of claim 1, wherein the cover is composed of a thermoplastic polyurethane elastomer having a tan δ peak temperature, in the measurement of viscoelasticity, not higher than −15° C. but not lower than −50° C.

5. The golf ball of claim 1, wherein the cover material is a reaction product between a thermoplastic polyurethane elastomer and an isocyanate compound.

* * * * *